US007036580B2

(12) United States Patent
McGarian et al.

(10) Patent No.: US 7,036,580 B2
(45) Date of Patent: May 2, 2006

(54) DOWNHOLE MOTOR LOCK-UP TOOL

(75) Inventors: Bruce McGarian, Aberdeen (GB); Ian A. Gillies, Angus (GB)

(73) Assignee: Smith International Inc., Houston, TX (US)

( * ) Notice: Subject to any disclaimer, the term of this patent is extended or adjusted under 35 U.S.C. 154(b) by 0 days.

(21) Appl. No.: 10/416,889

(22) PCT Filed: Jul. 30, 2002

(86) PCT No.: PCT/GB02/03483

§ 371 (c)(1),
(2), (4) Date: May 16, 2003

(87) PCT Pub. No.: WO03/012242

PCT Pub. Date: Feb. 13, 2003

(65) Prior Publication Data

US 2004/0011520 A1 Jan. 22, 2004

(30) Foreign Application Priority Data

Jul. 30, 2001 (GB) ..... 0118521
Oct. 10, 2001 (GB) ..... 0124349

(51) Int. Cl.
*E21B 23/02* (2006.01)
*E21B 17/046* (2006.01)

(52) U.S. Cl. ..... 166/117.7; 166/242.6; 175/101; 175/320

(58) Field of Classification Search ..... 166/104, 166/117.7, 301, 242.6; 175/92, 101, 106, 175/107, 320; 464/18, 137
See application file for complete search history.

(56) References Cited

U.S. PATENT DOCUMENTS 4,299,296 A * 11/1981 Geczy ..... 175/65
4,890,682 A * 1/1990 Worrall et al. ..... 175/61
5,472,057 A * 12/1995 Winfree ..... 175/57
6,082,457 A * 7/2000 Best et al. ..... 166/301
6,196,336 B1 * 3/2001 Fincher et al. ..... 175/101

* cited by examiner

*Primary Examiner*—Kenneth Thompson
(74) *Attorney, Agent, or Firm*—Dykema Gossett PLLC

(57) ABSTRACT

The present invention relates to downhole apparatus for limiting rotation of a rotor (4) relative to a stator (8) associated with said rotor (4). Apparatus according to the invention is provided with a locking member (12) movable from a first axial position to a second axial position by the application of a static fluid pressure to a differential area of said locking member (12). The apparatus is characterised by means for selectively applying static fluid pressure to said differential area of said locking member (12).

20 Claims, 8 Drawing Sheets

DOWNHOLE MOTOR LOCK-UP TOOL

BACKGROUND OF INVENTION a. Field of Invention

The present invention relates to downhole apparatus and particularly, but not exclusively, to downhole apparatus for use in releasing a stuck drill bit.

b. Description of Related Art

It is not uncommon for a drill bit to become stuck inhole during downhole oil and gas drilling operations. In order to allow retrieval of a downhole drill string when a drill bit becomes stuck, it is known to provide a drill string with an emergency release joint immediately uphole of the drill bit. During normal operation, the release joint transmits torque from a motor or string (from surface) to the drill bit. However, in the event that the drill bit becomes stuck to the extent that axial and rotational movement of the drill bit is not possible, the drill bit may be separated from the remainder of the drill string by virtue of the release joint. The remainder of the drill string may then be moved axially uphole so that specialist retrieving equipment may be run to the drill bit in a fishing operation.

Although the prior art release joints are effective in providing a system for releasing the drill bit from a wellbore, the steps of retrieving the drill string and subsequently running a fishing string is time consuming and expensive.

It is an object of the present invention to provide apparatus allowing a stuck drill bit to be conveniently, rapidly and inexpensively released from a wellbore.

SUMMARY OF INVENTION

Concept Possibilities

1. Sprag-Clutch in the Motor Output-Shaft Bearing Assembly (A) Advantages

A1) A sprag clutch assembly mounted at the lower end of the output shaft will give the strongest torque transmission design as the torque will be transmitted down through the motor casing threads, then through the bearing casing to the sprag assembly and then directly onto the motor output shaft bit box. This results in the torque not being limited by the torsional strength of the rotor end connection, universal joint (or flexible shaft) or end connections, or the output shaft/shaft coupling strength which will be much weaker than the casing threaded connections. It should be feasible to design an assembly with a large number of long sprags to transmit high torque level required.

B) Disadvantages

B1) The sprag clutch should preferably be run in a sealed bearing assembly in an oil reservoir as the sprag would wear along with the shaft surface unless hard-faced with tungsten carbide or something similar.

B2) The sprag clutch may inadvertently jam if not run in an oil-reservoir sealed bearing assembly.

B3) The motor shaft bearing assembly would probably have to be re-designed to lengthen it to allow the incorporation of the sprag clutch assembly and there are still many motors without a sealed bearing assembly. No Drilex motors have sealed bearing shaft assemblies, although 6¾" and 3¾" assemblies were tested with only 50% success 13 and 9 years ago respectively. However, all National Oilwell motors (Trudrills and Vector models) have sealed bearing shaft assemblies. Most Canadian motor companies appear to have gone in the direction of sealed assemblies.

2. Burst Disc in the Universal Assembly Housing

A) Advantages

A1) The burst disc could be sized to rupture just below the pump pop-off valve pressure setting so that when the bit gets stuck and possibly the bit ports get blocked and stop flow, then the motor power section will not be able to have the mud passing through it and so the rotor/stator will not be able to produce the torque needed to free the bit. The pressure will build up rapidly even with a mud lubricated bearing assembly so that even with mud flowing down the bearing assembly, if this passage is not blocked at the bottom end, the pressure build-up would be quick resulting in the rupture of the burst disc. There will then be a flow path for the mud flow and hence an opportunity to re-establish a dynamic pressure drop across the power section and hence torque output to the bit.

B) Disadvantages

B1) The only disadvantage is that the disc could rupture when not required when drilling ahead and there would be no loss of power to the power section but there would be across the bit and hence an increased change of a drop in RPO due to inadequate cutter cleaning. The likelihood of this happening should be fairly small assuming also the disc is sealed correctly to prevent leakage.

3. Motor Lock-Up Tool Mounted in the Motor Universal Housing Assembly-Lower End

A) Advantages

A1) A pull activated lock-up tool within a motor must be located within the rotor/stator or within the universal/flexible shaft assembly as the inners must have axial travel with respect to the outers, and within the motor bearing assembly the axial travel is not possible or at least only the play in the bearing pack is available and this is usually only 0 to ¼" maximum, even on a worn assembly. It may be feasible to have a shear pinned slip joint as on a mechanical disconnect and after a given travel of 6–8" to have a female spline built into the outer universal housing, travel over a male spline on the motor output shaft coupling. This placement would be preferable with respect to the top end of the rotor which could result in a failure at the universal/flexible shafts or at the connections or taper drives at either end. Taper drives work well in a motor to transmit torque but are always accompanied by high rotor downthrust.

B) Disadvantages

B1) There is not much room in the area outside the output shaft coupling to install this type of design to produce a strong assembly.

4. Motor Lock-Up Tool Mounted at the Top of the Rotor

A) Advantages

A1) Easier to design compared to the installation of a unit over the shaft coupling and would perhaps be easier to install than a sprag clutch as most motors will have to have the shaft assembly redesigned i.e. lengthened to accommodate a sprag clutch. For this design, as with all options discussed here, the rotor should be solid or have a blank nozzle fitted to attain maximum torque output with maximum flow rate so that there is more chance to free the bit if it gets stuck without the need for having to activate the lock-up tool.

B) Disadvantages

Weakest option from a torque transmission point of view as the rotor/universal/output shaft coupling and inter-connections would see all the transmitted string torque without hydraulic downthrust which could lead to taper drives turning also in motors which have this type of connection rather than threaded connections at either end of the universal. All Driflex motors used to have two or four 1:10 or 1:20 taper drives.

5. Fitting of a Splined Ring Over the Motor Bit Box

The fitting of an externally splined and internally splined ring in the lower housing of a motor may be feasible so that with some form of activation the ring travels down to engage over a male spline machined on the motor bit box. The means to activate the movement of this ring however may not be feasible as hydraulic communication is limited, as is the use of applying weight to activate its movement. If a design was feasible then this would perhaps be stronger than a sprag clutch design but the presence of cuttings may not allow the ring to move or engage fully. The same could be said if the bit got stuck by the hole collapsing.

The present invention provides downhole apparatus for limiting rotation of a rotor relative to a stator associated with the said rotor, the downhole apparatus comprising a body within a bore of which a locking member is located so as to be movable between a first axial position relative to the body, in which the locking member is disengaged from a rotor so as to allow rotation of said rotor relative to said locking member, and a second axial position relative to the body, in which the locking member is engaged with said rotor so as to limit rotation of said rotor relative to said locking member, the apparatus further comprising means for limiting rotational movement of the locking member relative to the body when said locking member is located in said second axial position, wherein said locking member is movable from said first axial position to said second axial position by the application of a static fluid pressure to a differential area of said locking member, the apparatus being characterised by means for selectively applying static fluid pressure to said differential area of said locking member.

A further aspect of the present invention provides downhole apparatus for limiting rotation of a rotor relative to a stator associated with the said rotor, the downhole apparatus comprising a body within a bore of which a locking member is located so as to be movable between a first axial position relative to the body, in which the locking member is disengaged from a rotor so as to allow rotation of said rotor relative to said locking member, and a second axial position relative to the body, in which the locking member is engaged with said rotor so as to limit rotation of said rotor relative to said locking member, the apparatus further comprising means for limiting rotational movement of the locking member relative to the body when said locking member is located in said second axial position, wherein said locking member is selectively retained in the first axial position by retaining means.

Thus, the body of downhole apparatus according to the present invention may be secured to the stator of a motor so that, in use, torque transmitted from the motor to a drill bit may be reacted to the surface via the apparatus body. In the event that the drill bit becomes stuck inhole and the torque generated by the motor is insufficient to effect release, the selective retaining means may be activated so as to allow movement of the locking member from the first axial postion into the second axial position wherein rotation of the locking member relative to both the rotor and the body is limited. In this way, the rotor is secured to the apparatus body in such as manner as to allow torque applied to the body at the surface to be transmitted to the rotor. In this way, rotational force over and above that generated by the motor itself can be applied to the drill bit in an attempt to release the bit from the well bore.

BRIEF DESCRIPTION OF THE DRAWINGS

Embodiments of the present invention are shown in the accompanying drawings, in which.

DETAILED DESCRIPTION OF THE PREFERRED EMBODIMENTS

The accompanying drawings illustrate downhole apparatus 2 for limiting rotation of a rotor 4 relative to a stator 6 associated with said rotor 4.

Figure 1:
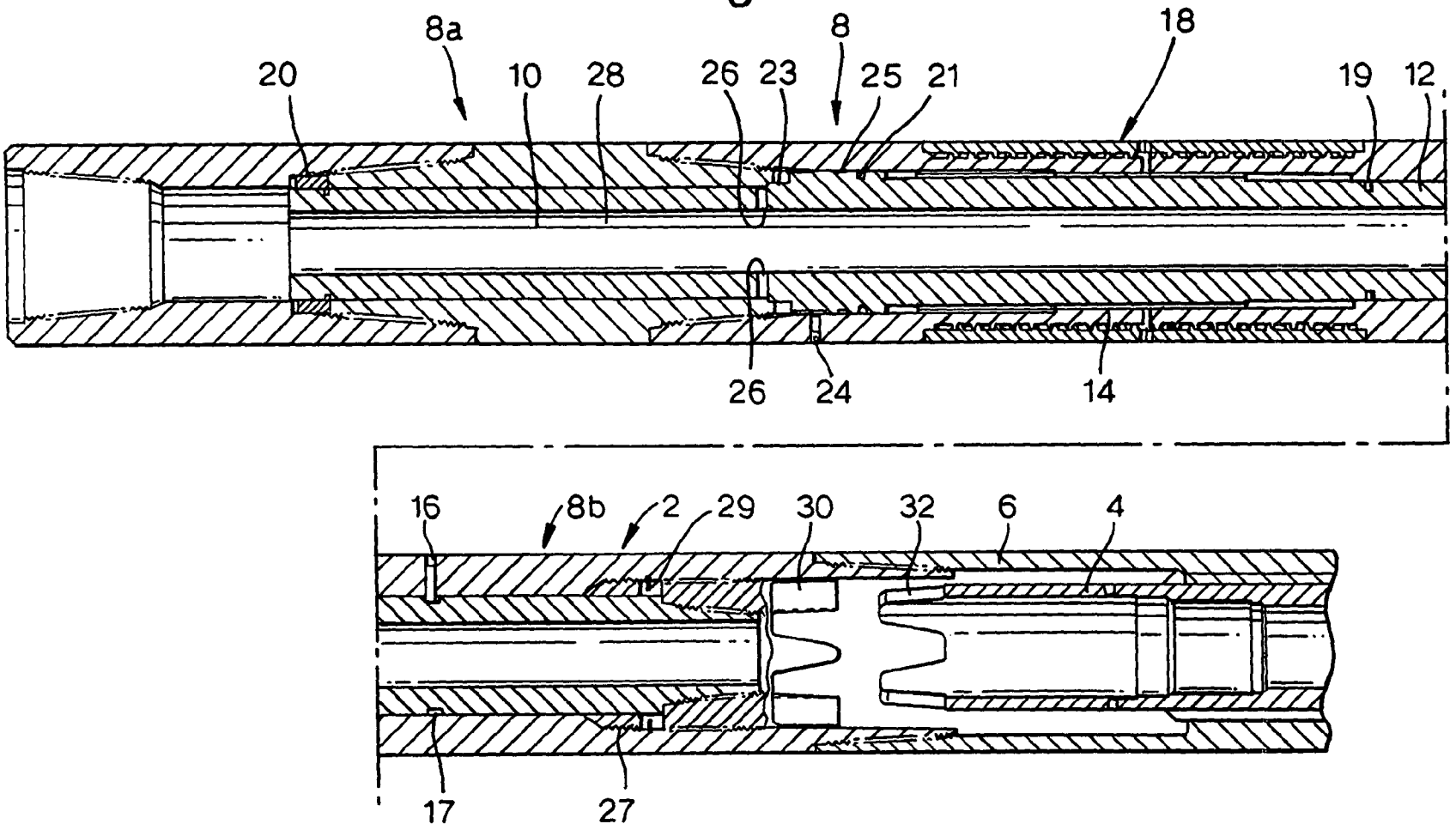
FIG. 1 shows a cross-sectional side view of an embodiment of the present invention wherein the locking member is arranged in a first axial position.
Figure 3:
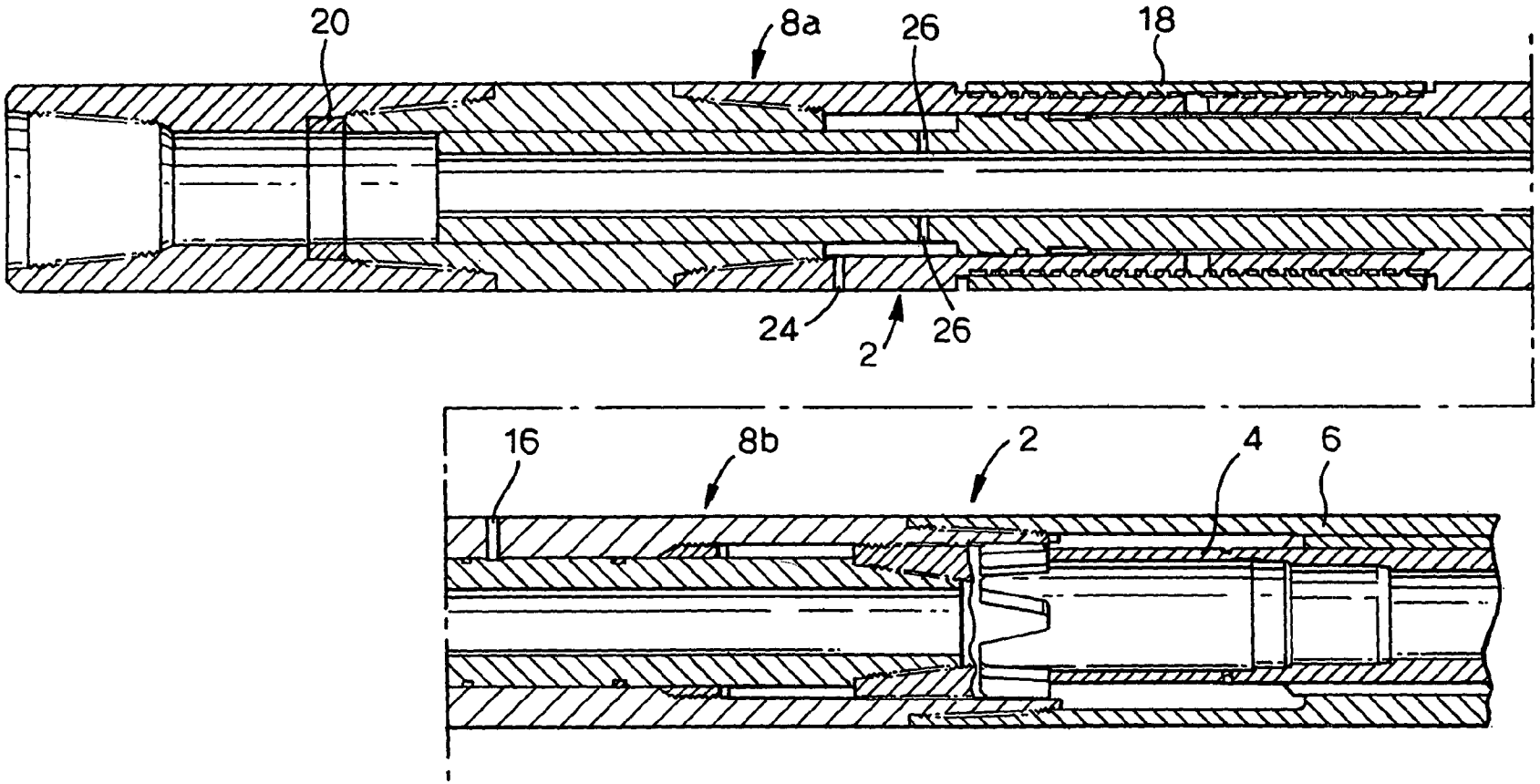
FIG. 3 is a cross-sectional side view of the embodiment wherein the locking member is arranged in a second axial position.

The downhole apparatus 2 further comprises a body 8 within a bore 10 of which a locking member 12 is located so as to be movable between a first axial position (see FIG. 1) and a second axial position (see FIG. 3). In the first axial position relative to the body 8, the locking member 12 is disengaged from the rotor 4 so as to allow rotation of said rotor 4 relative to said locking member 12. In the second axial position relative to the body 8, the locking member 12 is engaged with the rotor 4 so as to limit rotation of said rotor 4 relative to said locking member 12. The apparatus 2 comprises means for limiting rotational movement of the locking member 12 relative to the body 8 when said locking member 12 is located in said second axial position. This limiting means comprises interlocking axially extending splines 14 defined on the body 8 and the locking member 12. Retaining means 16 is also provided for selectively retaining the locking member 12 in the first axial position. This retaining means comprises a shear pin secured to the body 8 and extending into an annular groove 17 defined in an outer surface of the locking member 12. Three O-ring seals 19,21,23 and a glyd ring 25 are located between the body 8 and the locking member 12.

The body 8 of the apparatus 2 comprises two portions 8*a*, 8*b* which are retained together by means of a loose fitting threaded coupling 18. The coupling 18 allows the two body portions 8*a*, 8*b* to move axially apart from one another into the intermediate configuration shown in FIG. 2. In moving to said intermediate configuration, a shear ring 20 attaching the first body portion 8*a* to the locking member 12 fractures. In order to move the apparatus 2 into the intermediate configuration, the first body portion 8*a* is pulled uphole with sufficient force to fracture the shear ring and thereby separate the two body portions 8*a*, 8*b*. In moving to the intermediate position, the first body portion 8*a* defines an annular fluid chamber 22 with the locking member 12. Hydraulic lock in creating the chamber 22 is prevented by means of a one way vacuum release valve 24 located in the wall of the first body portion 8*a*. In the intermediate configuration, hydraulic transfer ports 26 defined in the locking member 12 provide fluid communication between a bore 28 extending through the locking member 12 with the chamber 22.

A locking ring 27 is retained between the locking member 12 and the second body portion 8*b* by means of a circlip 29. Ratchet teeth on the locking ring 27 engage ratchet teeth on the locking member 12. The arrangement is such as to permit movement of the locking member 12 towards the rotor 4 whilst opposing movement in the opposite direction.

Figure 2:
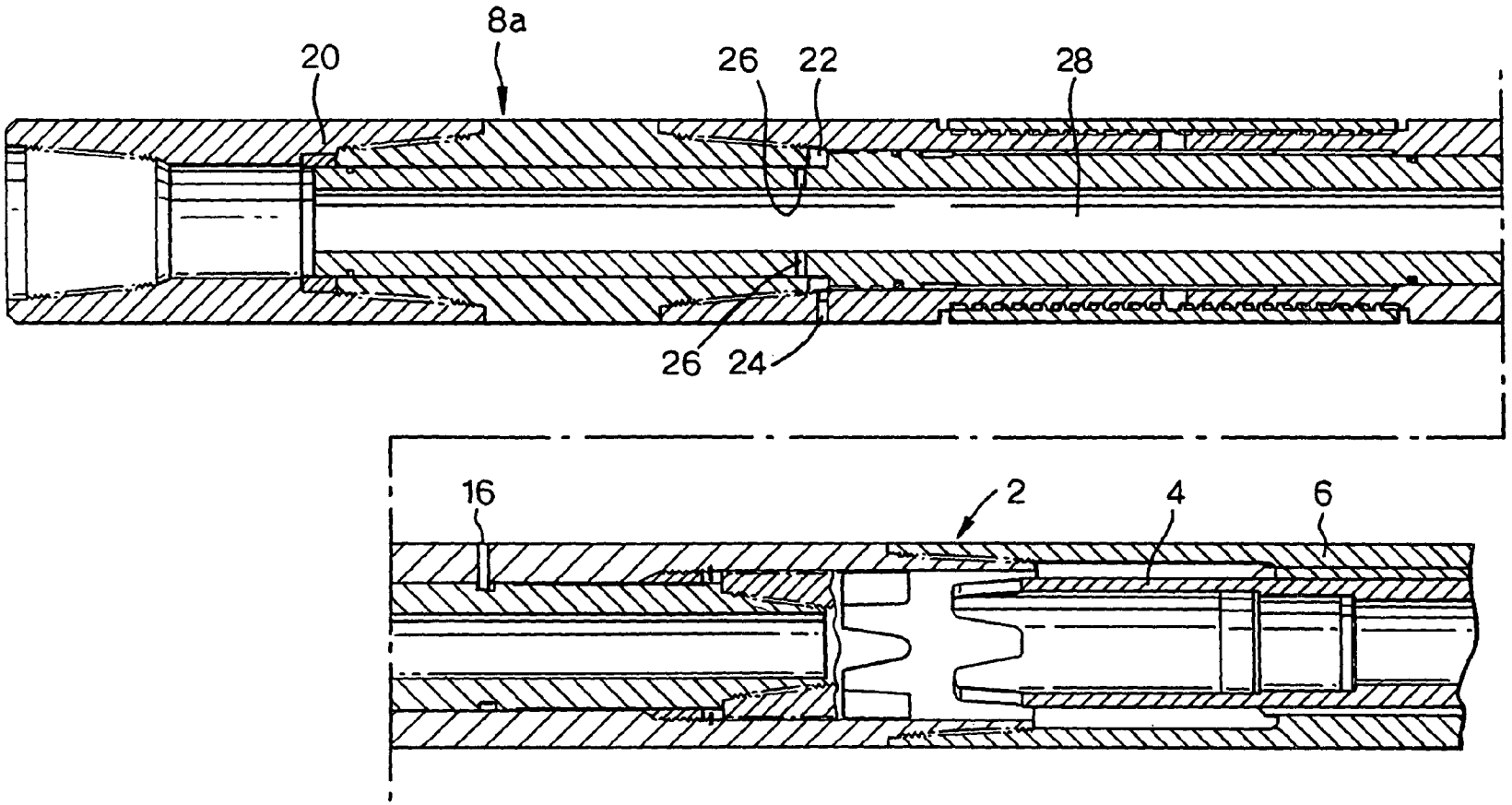
FIG. 2 is a cross-sectional side view of the embodiment of FIG. 1 wherein the locking member is arranged in an intermediate axial position.

It will be understood from reference to FIG. 2 that, when in the intermediate configuration, the locking member 12 remains spaced from the rotor 4. In order to engage the locking member 12 with the rotor 4, fluid pressure within the bore 28 of the locking member 12 is increased. Dynamic pressure caused by a fluid flow through the apparatus 2 will allow a force to be generated which presses the locking member 12 towards the rotor 4. Also, the geometry of the locking member 12 is such that a differential in area of locking member 12 exposed to wellbore fluid exists. This area differential is generated by virtue of the annular chamber 22. Thus, once the apparatus is in the intermediate configuration, static pressure within the bore 28 tends to press the locking member 12 into engagement with the rotor 4.

Once the biasing force applied to the locking member 12 is sufficient to overcome the retaining force of the shear pin 16, the shear pin 16 shears and the locking member 12 moves downhole into engagement with the rotor 4. The locking member 12 and rotor 4 are provided with interlocking teeth members 30,32 respectively which, when engaged with one another, prevent relative rotation between the locking member 12 and the rotor 4. Relative rotation between the body 8 and the rotor 4 is thereby prevented.

Figure 4:
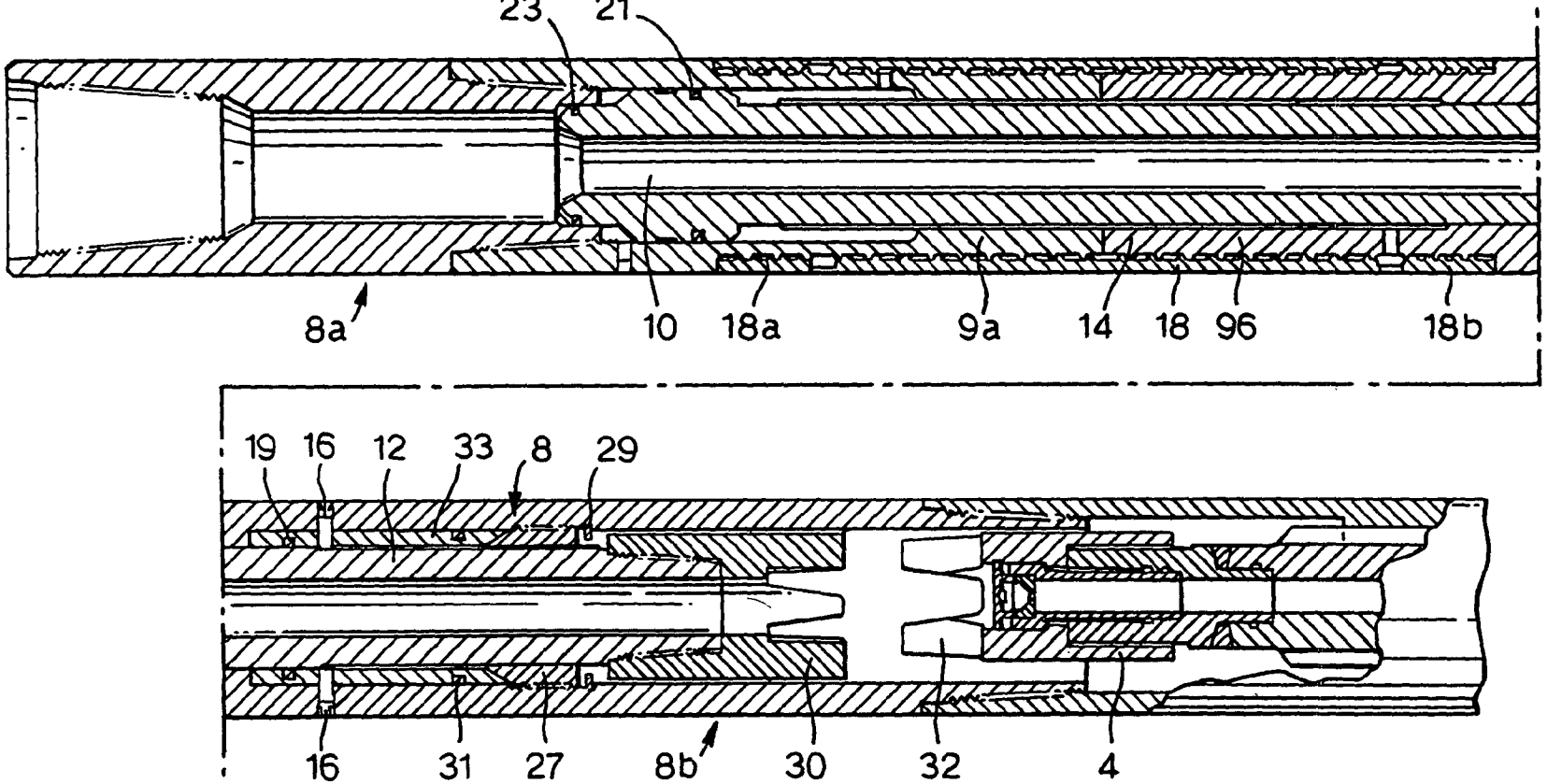
FIG. 4 is a cross-sectional side view of a second embodiment.
Figure 5:
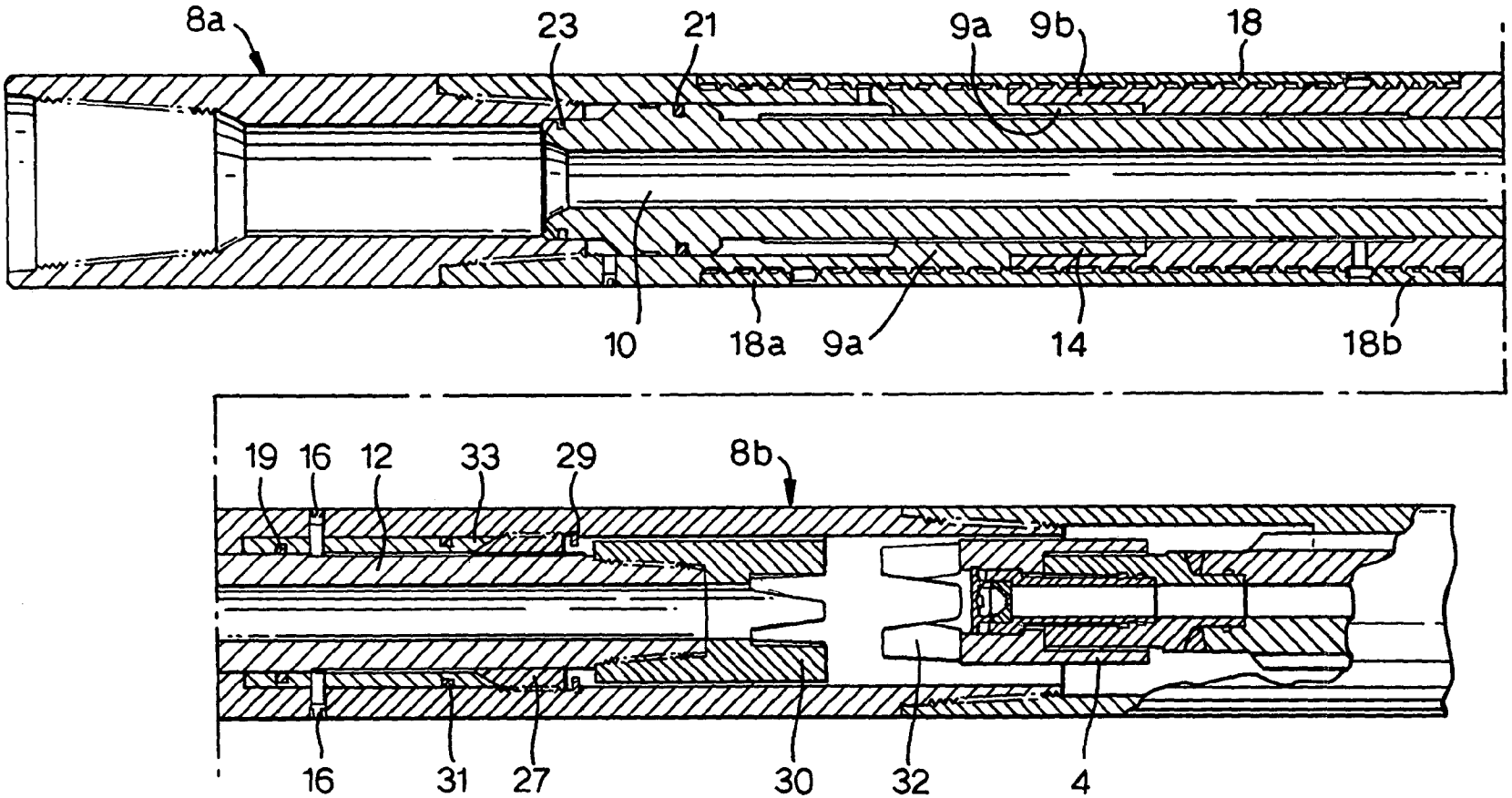
FIG. 5 is a cross-sectional side view of a third embodiment.
Figure 6:
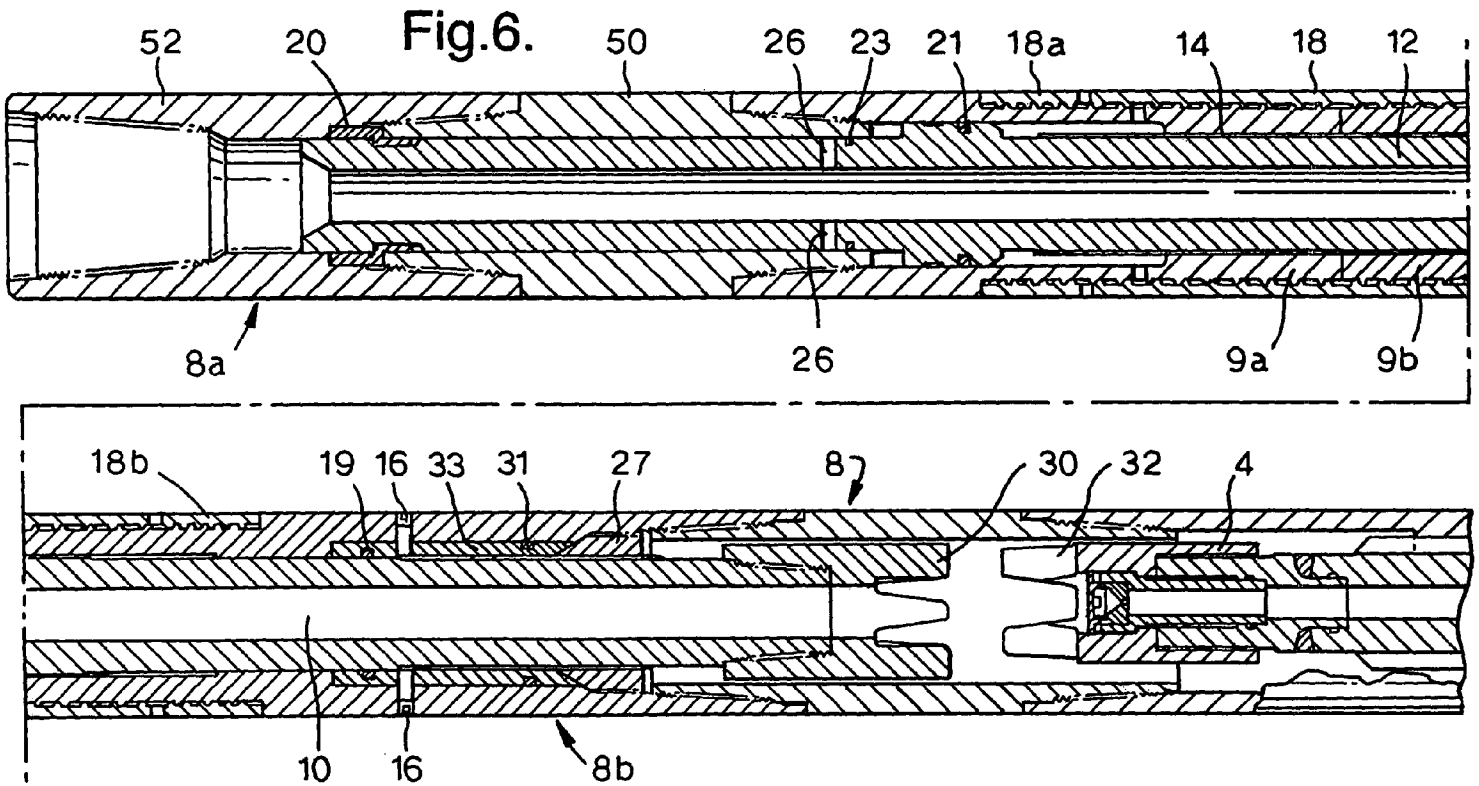
FIG. 6 is a cross-sectional side view of a fourth embodiment wherein the locking member is arranged in a first axial position.

The present invention is not limited to the specific embodiment described above. Alternative arrangements will be apparent to the reader skilled in the art. Two further embodiments are shown in FIGS. 4 and 5 of the accompanying drawings. These two embodiments are similar to the embodiment of FIGS. 1 to 3 but comprise a number of modifications as described below. Corresponding parts of the embodiments are identified with like reference numerals.

In the further two embodiments the two shoulders at either end of the outer casing 18,18*a*,18*b* are pre-loaded by the applied make-up torque through added threaded portions 18*a*,18*b* at each end which do not have one of the thread starts removed. Also, the shear ring mounted at the top of the central (locking) shaft 12 on the first embodiment is replaced by shear pins 16 at the lower end of the shaft.

The central shaft 12 has three diametrical seals 19,21,23 working on it. The first two 21,23 are at the top (left-hand) end while the third is at the lower (right-hand) end. The uppermost seal, plus the one at the bottom, act on the same effective diameter. The third seal is sealing on a larger diameter. The purpose of the two smaller seals acting on the same diameter is to ensure that the shaft does not have a load acting on it (up or down) with internal pressure until the assembly has been activated by an axial pull. The shaft has a castellated adapter screwed onto it which has a profile facing downwards to mate with a special castellated adapter attached to the top end of a downhole motor rotor. The castellations 30,32 are designed to mesh when the tool has been activated and thereby torsionally lock the rotor with respect to the outer casings so that torque from surface (or at least from above the assembly) can be applied down through the rotor to the stuck bit. The central shaft 12 is held in the assembled position by both shear pins 16 and a serrated split collar 27 below the shear pins.

The outer casings 18,18*a*,18*b* in the middle of each tool are designed with a unique design of threaded joint. As shown in FIGS. 4 and 5, the thread is a two-start thread which has been machined as a female box style thread from end to end on the outer casing. The inner section 18 approx. 3–4" from each end (i.e. between the illustrated undercuts) has one of the threads removed thereafter by machining. The pins 9*a*,9*b* of the casings 18*a*,18*b* either side of the central casing 18, which are linked by the central casing 18, also have one of the thread starts removed. The upper and lower pins 9*a*,9*b* are held together by the outer casing 18, 18*a*, 18*b* screw threads at either end of the outer casing. The connections are torqued up right hand conventionally and so, with left hand torque from the motor stator, the right hand threads will tighten when the motor is working and so will not unscrew. The threads removed from the pins 9*a*,9*b* and box between the outer casing undercuts allow axial travel between the top and bottom of the tool when an overpull is applied (which overpull is at least equal to the load required to shear the outer casing in the area of the undercuts). The 4¾" version of the tool shown in FIGS. 4 and 5 is designed to shear at 80,000 lbs pull. The bending stiffness of the assembly is enhanced in the assembly of FIG. 5 by the overlap of the two threaded pins 9*a*,9*b* by the spigot engagement in the wall section between the internal splines 14 and the external two start thread.

The axial pull will also result in the tool stroking open by the total available movement from the removal of the threads in the central area of the outer casing 18,18*a*,18*b*. When this happens, the uppermost seal 23 will be removed from the bore of the top sub 8*a*. When internal hydraulic pressure is applied as the rig pumps are turned on and the pressure between the inside and outside of the tool reaches a certain level, the shear pins 16 will shear and the central shaft 12 will be moved downwards. When the shaft moves down the castellations 30,32 of the two adapters will engage and torque can then be applied directly down the centre of the internal motor drive assembly from the surface via the splines 14 meshing the internal centre shaft and the external casings. The centre shaft 12 cannot move back up due to the serrations on the split collar 27 locating around the centre shaft at the lower end. The circlip 29 in the lowermost casing bore acts as a stop shoulder to prevent the split stop collar 27 moving down.

It is to be noted that the area around the splines and the double start threads are at the external lower pressure and hence the sealing of the inside of the tool is completed by the seal 31 on the outside of the sleeve 33 through which the shear pins are located 10 of the centre shaft and through the castellated adapter screwed onto the centre shaft. The castellations may or may not be designed to seal off the flow to the outside of the adapters when the two sets mesh together. If they are designed to seal off the flow into the rotor-stator profile, it would be beneficial to have a nozzle fitted in the top of the rotor so that a flow path is available down the centre of the rotor and then either simply down to the bit as in a conventional motor or out through a nozzle fitted in the universal housing of the motor. A nozzle fitted in the side of the motor would be beneficial in some circumstances as circulation would still be possible if the formation collapsed around the bit and blocked off the flow path around the outside of the bit.

Figure 7B:
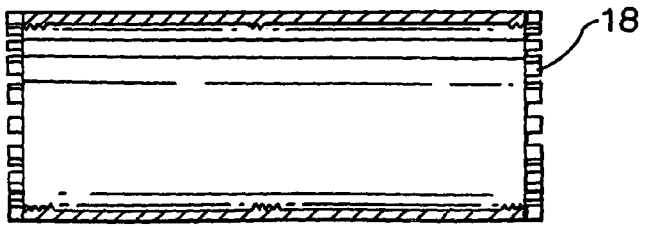
FIG. 7 is an end view and a cross-sectional side view of a coupling of the fourth embodiment.
Figure 7A:
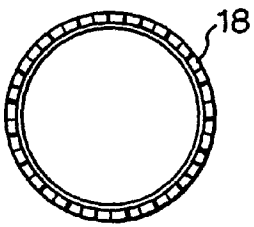
Figure 8:
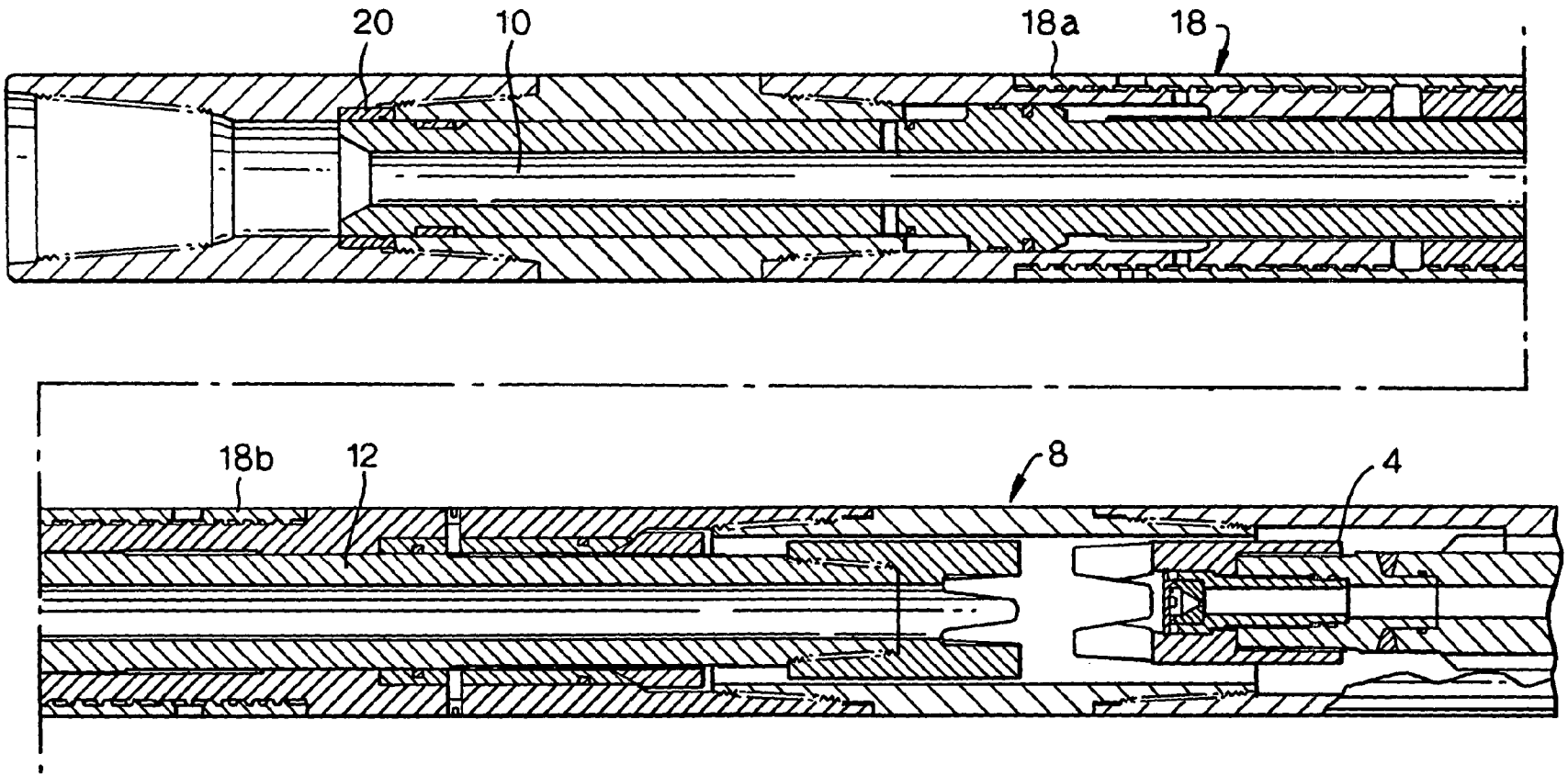
FIG. 8 is a cross-sectional side view of the fourth embodiment wherein the locking member is arranged in an intermediate axial position.
Figure 9:
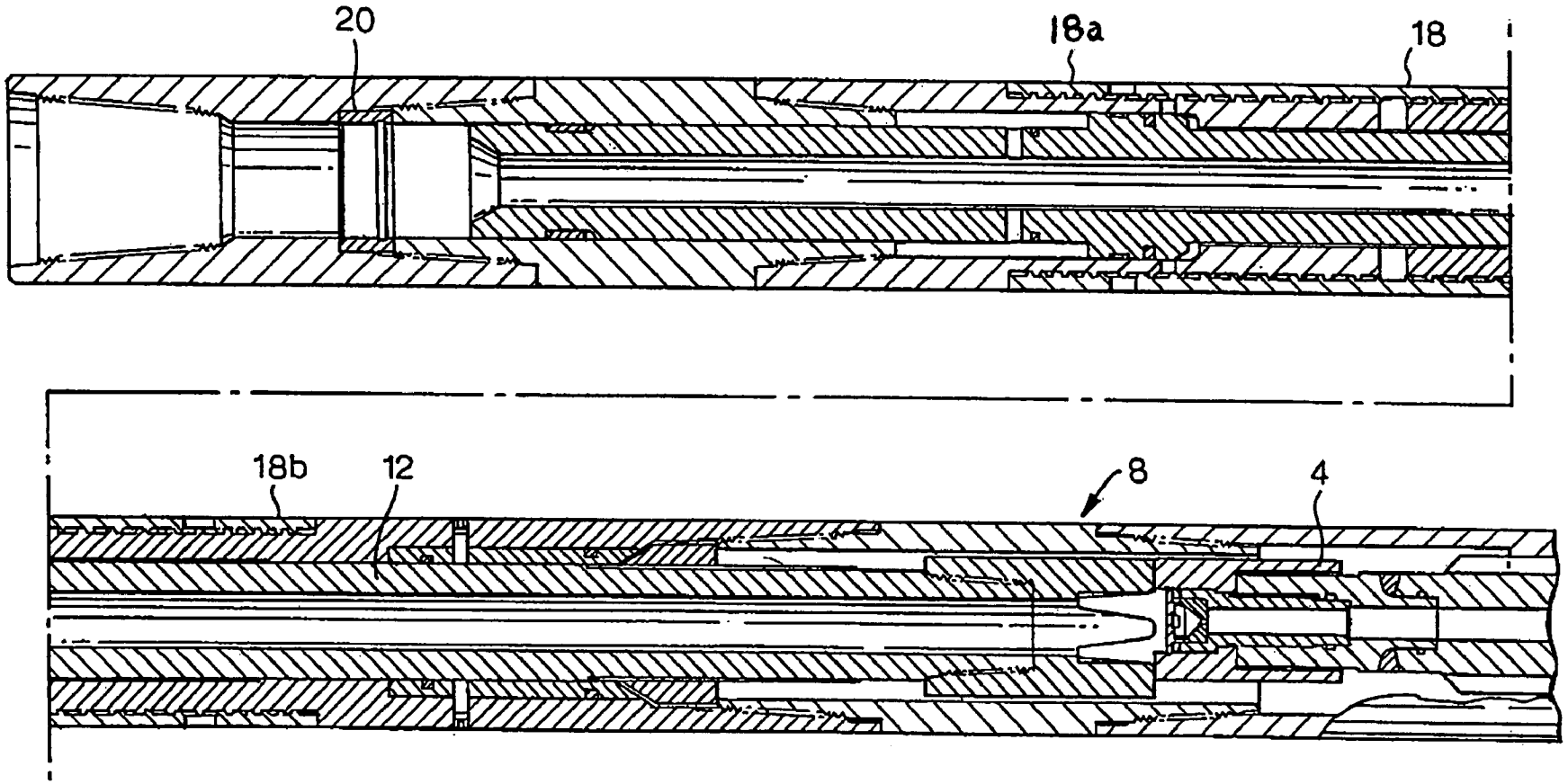
FIG. 9 is a cross-sectional side view of the fourth embodiment wherein the locking member is arranged in a second axial position.

A yet further embodiment of the present invention is shown in FIGS. 6 to 9 of the accompanying drawings. This further embodiment is again similar to the embodiment of FIGS. 1 to 3 and corresponding parts are identified with like reference numerals. The further embodiment principally differs from the first embodiment in that the single shear pin of the first embodiment is placed with a pair of shear pins 16 which pass through a sleeve 33 as in the second and third embodiments of FIGS. 4 and 5. Also, as described in relation to the second and third embodiments, the third embodiment shown in FIGS. 6 to 9 comprises a seal 31 provided on the outside of the sleeve 33. The further embodiment also retains the shear ring 20 and the hydraulic transfer ports 26. The further embodiment also differs from the first embodiment in that the threaded coupling is provided in three discrete portions. A central portion 18 (as shown in FIG. 7) spans the first and second body portions 8*a*,8*b*. The second portion 18*a* of the coupling is screw threaded to the first body portion 8*a* whilst the third coupling portion 18*b* is screw threaded to the second body portion 8*b*. As for the previous embodiments, the coupling engages a two-start thread on the body 8 wherein one of the threads is removed. Similarly, the central portion 18 of the coupling has a two-start thread wherein one thread is removed. However, the remaining coupling portions 18*a*,18*b* have an unmodified two-start thread which allows said portions to be locked against respective shoulders of the first and second body portions 8*a*,8*b*. The ends of the second and third coupling portions 18*a*,18*b* distal to said respective shoulders are provided with castellations for engagement with castellations provided on the ends of the central coupling portion 18. With the castellations of the three portions 18,18*a*,18*b* engaged with one another, a torque may be transmitted through the coupling and the arrangement assists in assembly of the tool. In other respects, and in operation, the tool is the same a described in relation to the first embodiment. Indeed, FIGS. 8 and 9 show the locking member 12 of the further embodiment in intermediate and second axial positions respectively. It will be seen from each of these Figures that the castellations of the coupling allow the three coupling portions to move axially away from one another.

The fourth embodiment shown in FIGS. 6 to 9 is assembled under the following procedure:

Step 1—make up second coupling portion 18*a* (upper lock ring) to first body portion 8*a* (upper body).

Step 2—make up third coupling portion 18*b* (lower lock ring) to second body portion 8*b* (lower body) and assemble seal sleeve 33 complete with seals. Hold in position with a slave screw (not shown).

Step 3—thread first and second body portions 8*a*,8*b* to central coupling portion 18 while maintaining sufficient axial tension force to ensure maximum separation of the body pins 9*a*,9*b*. When made up, the castellations of the coupling portions 18,18*a*,18*b* will be aligned. Compress the sub-assembly axially so as to engage castellations.

Step 4—hold body assembly in torque unit and apply sufficient torque to align internal splines 14. Do not exceed make up torque.

Step 5—slide over cross-over sub 50 of first body portion 8*a* onto the locking member 12 (complete with seals).

Step 6—slide locking member 12 through the body assembly to engage fully with aligned internal splines 14. Make up cross-over sub 50 to first body portion pin 9*a* (hand tight).

Step 7—insert shear ring segments 20 and push locking member 12 down to locate fully. In order to displace trapped air, slightly back off the cross-over sub 50.

Step 8—make up top sub 52 of the first body portion 8*a* and tighten to recommended make up torque.

Step 9—assemble shear pins 16 and associated plugs.

Step 10—assemble locking ring 27 and, with specialist tool, make up to recommended torque.

Step 11—connect castellated adapter to locking member 12 and, with specialist tool, make up to recommended torque.

Step 12—assemble bottom sub and make up to recommended torque.

In assembling any of the embodiments described herein, it will be appreciated that the locking ring 27 is ideally made up to a torque sufficient to place the two body portions 8*a*,8*b* in abutment with one another and under compression. Although the first embodiment (see FIG. 1) is provided with a gap between said portions 8*a*,8*b* of the body, it is preferable for these portions to abut one another as in the second, third and fourth embodiments. In this way, the tool may be placed in compression so as to provide rigidity.

Yet further alternative arrangements will be apparent to the reader skilled in the art.

The invention claimed is:

1. Downhole apparatus for limiting rotation of a rotor for transmitting torque to a downhole tool relative to a stator associated with the said rotor, the downhole apparatus comprising a body within a bore of which a locking member is located so as to be movable between a first axial position relative to the body, in which the locking member is disengaged from a rotor so as to allow rotation of said rotor relative to said locking member, and a second axial position relative to the body, in which the locking member is engaged with said rotor so as to limit rotation of said rotor relative to said locking member, the apparatus further comprising means for limiting rotational movement of the locking member relative to the body when said locking member is located in said second axial position, wherein said locking member is movable from said first axial position to said second axial position by the application of a static fluid pressure to a differential area of said locking member, and means for selectively applying static fluid pressure to said differential area of said locking member.

2. Downhole apparatus as claimed in claim 1, wherein said selective means for applying static fluid pressure comprises means for permitting intermediate movement of said locking member from said first axial position to an intermediate position relative to the body wherein the area of locking member exposed to said static fluid pressure is different to that exposed to said static fluid pressure when said locking member is located in said first axial position.

3. Downhole apparatus as claimed in claim 2, wherein said body comprises two portions movable relative to one another so as to permit said intermediate movement of said locking member relative to one of said body portions.

4. Downhole apparatus as claimed in claim 3, wherein said body portions are axially movable relative to one another.

5. Downhole apparatus as claimed in claim 3, wherein said locking member is selectively retained in said first axial position relative to said one body portion by frangible means.

6. Downhole apparatus as claimed in claim 3, wherein said locking member is selectively retained in said first axial position and said intermediate position relative to the other one of said body portions.

7. Downhole apparatus as claimed in claim 3, wherein said two body portions are screw threadedly connected to one another.

8. Downhole apparatus as claimed in claim 7, wherein the screw threaded connection between said two body portions is sufficiently loose to permit said relative intermediate movement between said locking member and said one body portion.

9. Downhole apparatus as claimed in claim 8, wherein said screw threaded connection comprises a two-start thread with one of the two threads thereof removed.

10. Downhole apparatus as claimed in claim 9, wherein said screw threaded connection comprises a thread collar spanning said two body portion.

11. Downhole apparatus for limiting rotation of a rotor for transmitting torque to a downhole tool relative to a stator associated with the said rotor, the downhole apparatus comprising a body within a bore of which a locking member is located so as to be movable between a first axial position relative to the body, in which the locking member is disengaged from a rotor so as to allow rotation of said rotor relative to said locking member, and a second axial position relative to the body, in which the locking member is engaged with said rotor so as to limit rotation of said rotor relative to said locking member, said locking member being engageable with said rotor by a plurality of complementary castellations respectively provided adjacent lowermost and uppermost ends of said rotor and said locking member, the apparatus further comprising means for limiting rotational movement of the locking member relative to the body when said locking member is located in said second axial position, wherein said locking member is movable from said first axial position to said second axial position by the application of a static fluid pressure to a differential area of said locking member, and means for selectively applying static fluid pressure to said differential area of said locking member.

12. Downhole apparatus as claimed in claim 11, wherein said selective means for applying static fluid pressure comprises means for permitting intermediate movement of said locking member from said first axial position to an intermediate position relative to the body wherein the area of locking member exposed to said static fluid pressure is different to that exposed to said static fluid pressure when said locking member is located in said first axial position.

13. Downhole apparatus as claimed in claim 12, wherein said body comprises two portions movable relative to one another so as to permit said intermediate movement of said locking member relative to one of said body portions.

14. Downhole apparatus as claimed in claim 13, wherein said body portions are axially movable relative to one another.

15. Downhole apparatus as claimed in claim 13, wherein said locking member is selectively retained in said first axial position relative to said one body portion by frangible means.

16. Downhole apparatus as claimed in claim 13, wherein said locking member is selectively retained in said first axial position and said intermediate position relative to the other one of said body portions.

17. Downhole apparatus as claimed in claim 13, wherein said two body portions are screw threadedly connected to one another.

18. Downhole apparatus as claimed in claim 17, wherein the screw threaded connection between said two body portions is sufficiently loose to permit said relative intermediate movement between said locking member and said one body portion.

19. Downhole apparatus as claimed in claim 18, wherein said screw threaded connection comprises a two-start thread with one of the two threads thereof removed.

20. Downhole apparatus as claimed in claim 19, wherein said screw threaded connection comprises a thread collar spanning said two body portion.

* * * * *